US008393283B2

(12) United States Patent
Cazzaro

(10) Patent No.: US 8,393,283 B2
(45) Date of Patent: Mar. 12, 2013

(54) DEVICE FOR ACTUATING SHEETS OF SAILING BOATS

(75) Inventor: Michele Cazzaro, Besozzo (IT)

(73) Assignee: Harken Italy S.p.A., Lurago Marinone (Como) (IT)

( * ) Notice: Subject to any disclaimer, the term of this patent is extended or adjusted under 35 U.S.C. 154(b) by 0 days.

(21) Appl. No.: 12/167,899

(22) Filed: Jul. 3, 2008

(65) Prior Publication Data

US 2009/0013915 A1 Jan. 15, 2009

(30) Foreign Application Priority Data

Jul. 11, 2007 (EP) ..... 07425429

(51) Int. Cl.
*B63H 9/04* (2006.01)

(52) U.S. Cl. ..... 114/102.19

(58) Field of Classification Search ..... 114/102.1, 114/102.12–102.19, 102.2–102.22, 104–109, 114/111

See application file for complete search history.

(56) References Cited

U.S. PATENT DOCUMENTS

| | | | | |
|---|---|---|---|---|
| 2,119,475 | A * | 5/1938 | Tamm | 114/107 |
| 3,889,620 | A * | 6/1975 | Dorland | 114/39.21 |
| 4,324,192 | A * | 4/1982 | Ingouf | 114/106 |
| 4,941,197 | A | 7/1990 | Roeser | |
| 5,022,277 | A * | 6/1991 | Shaffer | 74/424.9 |
| 5,080,200 | A | 1/1992 | Gibson | |
| 6,345,549 | B1 | 2/2002 | Lance | |
| 6,646,431 | B1 | 11/2003 | Parvez et al. | |
| 2003/0106391 | A1 | 6/2003 | McMillen | |
| 2006/0191362 | A1 | 8/2006 | Garrec | |

FOREIGN PATENT DOCUMENTS

| | | |
|---|---|---|
| EP | 0823372 A2 | 11/1998 |
| FR | 2756808 A1 | 12/1998 |
| NZ | 177238 | 3/1977 |
| WO | WO9309999 | 5/1993 |

OTHER PUBLICATIONS

European Search Report for EP07425429, Dec. 4, 2007.

* cited by examiner

*Primary Examiner* — Daniel Venne

(74) *Attorney, Agent, or Firm* — Brian G. Gilpin; Godfrey & Kahn, S.C.

(57) ABSTRACT

A device (1) for actuating sheets of sailing boats comprises a pulling element (2) for a sheet (200) and an actuator (3) connected to the pulling element (2) for causing the motion thereof. The actuator (3) comprises a screw (4) and a nut (7) engaged with each other, wherein one from the screw (4) and the nut (7) is rotated and the other translates linearly.

A boom (300) of a sailing boat (100) provided with the device (1) for actuating sheets of the invention is also described.

20 Claims, 6 Drawing Sheets

DEVICE FOR ACTUATING SHEETS OF SAILING BOATS

The present application claims priority to European Patent Application No. 07425429.3, filed on Jul. 11, 2007, the disclosure of which is incorporated herein by reference.

DESCRIPTION

The present invention refers to a device for actuating sheets of sailing boats comprising a pulling element for a sheet and an actuator for causing the motion of the pulling element.

The invention also refers to a boom of a sailing boat provided with such a device.

Within the framework of the present description and of the subsequent claims, the expression "actuation of sheets" is used generally to indicate any operation related to the adjustment of the tension of the sheet, by tightening or loosening them in a controlled manner, for adjusting the angle of incidence that the sails driven by such sheets present to the wind.

The actuation of sheets of a sailing boat can be carried out manually or else with the help of actuators. In particular, hydraulic devices for actuating sheets are known, which use hydraulic cylinders as actuators to cause the motion of a pulling element.

For example, patent IT 1298272 discloses a device for tensioning, recovering and releasing ropes and the like comprising a double-acting hydraulic cylinder that drives the stroke of a piston and a shaft for determining the recovery and tensioning, or else the release, of a rope. Deviations between which the rope is arranged are provided at the ends of the shaft and of the cylinder, for creating a device for multiplying the rope excursion with respect to the stroke of the shaft.

Although devices of this type are suitable for carrying out the aforementioned functions, the use of hydraulic actuators requires the availability on board the sailing boat of a hydraulic actuation circuit comprising a pumping station and a distribution system of a pressurised hydraulic fluid. This, however, is not always possible for reasons of overall size or costs, above all on small sailing boats.

The purpose of the present invention is to provide a device for actuating sheets of sailing boats that works without pressurised fluids and therefore can also be used on board sailing boats not equipped with hydraulic actuation circuits.

The invention therefore refers, in a first aspect thereof, to a device for actuating sheets of sailing boats according to claim 1. In a second aspect thereof, the invention refers to a boom of a sailing boat according to claim 13. Preferred characteristics of the aforementioned device and boom are indicated in the respective dependent claims.

In particular, in its first aspect the invention refers to a device for actuating sheets of sailing boats comprising a pulling element for a sheet and an actuator connected to said pulling element to cause the motion thereof, wherein said actuator comprises a screw and a nut engaged with each other and wherein one of said screw and said nut is rotated and the other translates linearly.

Advantageously, the device of the invention comprises a mechanical actuator that does not need a pressurised hydraulic fluid for its operation and therefore it can also be used on sailing boats that are not equipped with hydraulic actuation circuits.

Moreover, a nut and screw actuator potentially has a smaller longitudinal size compared with a hydraulic actuator of equal performance. The device for actuating sheets of the invention can therefore be advantageously more compact and more easily fitted to different types of assembly and application on board a sailing boat compared to known devices.

Both of these advantageous aspects make the device of the invention particularly suitable for use on small sailing boats.

In a preferred embodiment of the invention said actuator is configured so that the screw is rotated and the nut translates linearly.

In this configuration the longitudinal size of the actuator substantially coincides with its useful stroke. Therefore, having set a useful stroke, the longitudinal size of the actuator, and therefore of the device for actuating sheets of the invention, can be advantageously minimised.

In this case, preferably, the nut itself of the actuator is the pulling element.

Preferably, the actuator comprises rolling elements operatively interposed between the screw and the nut. More preferably, the actuator is a ball screw actuator.

Compared to a conventional threaded coupling, the use of rolling elements advantageously allows the friction between screw and nut to be reduced and therefore the conversion of the motion from rotary to translational to be carried out with a higher efficiency.

Preferably, the actuator comprises motor means to make the screw rotate and the motor means are substantially coaxial with the screw.

Advantageously, with this arrangement it is possible to give the actuator and the device for actuating sheets of the invention a substantially linear shape, which is suited for assembly in tubular-shaped components of the sailing boat, and in particular in a boom, as specified more clearly hereafter.

However, alternative embodiments are foreseen in which, because of specific constraints or installation requirements of the device of the invention, the motor means are axially oblique with respect to said screw.

Preferably, the actuator comprises a gear transmission operatively interposed between the motor means and said screw.

Such a gear transmission preferably comprises an epicyclic reduction gear, which advantageously allows high reduction ratios to be obtained with reduced overall size.

In order to avoid the adverse effects of salt corrosion, the rolling elements operatively interposed between the screw and the nut of the actuator are preferably made of plastic material. For the same reason, the screw and the nut of the actuator are preferably made of aluminium.

Preferably, the pulling element comprises at least one block in order to be able to multiply the length of sheet the can be recovered.

In the second aspect thereof, the invention refers to a boom of a sailing boat provided with a device for actuating sheets having the characteristics outlined above.

Preferably, the boom comprises a longitudinal inner cavity and the device for actuating sheets is housed in said inner cavity.

This arrangement is particularly advantageous because the device for actuating sheets is integrated in the boom itself and therefore its use does not reduce the space available on board and does not compromise the appearance of the sailing boat.

Preferably, the nut of the actuator of said device for actuating sheets translates linearly and in such a translation cooperates with at least one longitudinal portion of the inner cavity of the boom.

The boom is therefore advantageously used at least partially as a guide for the nut, in particular to prevent rotation thereof during translation movements, for a correct operation of the device for actuating sheets.

Further characteristics and advantages of the present invention shall become clearer from the following detailed description of preferred embodiments thereof, made hereafter, for indicating and not limiting purposes, with reference to the attached drawings. In such drawings.

Figure 1:
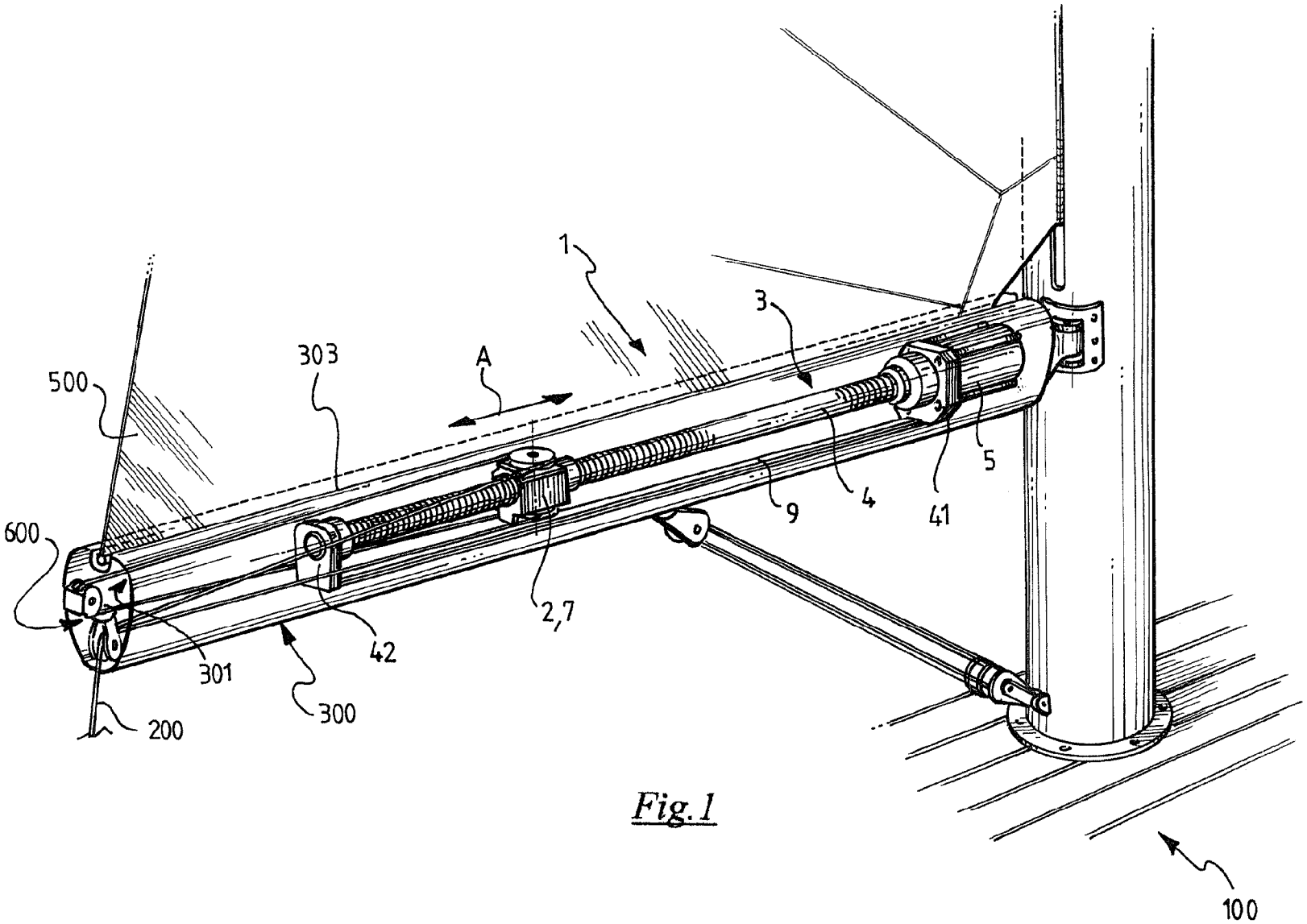
FIG. 1 is a schematic perspective view of a device for actuating sheets according to the invention mounted in a boom of a sailing boat.
Figure 2:
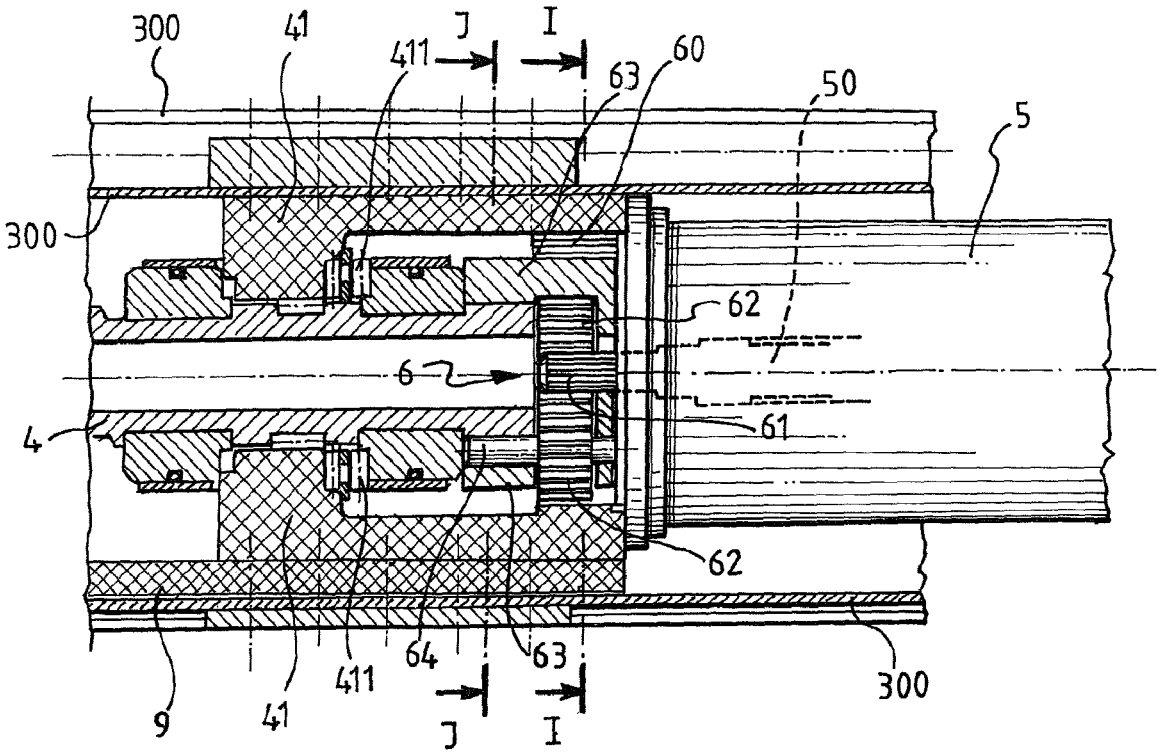
FIG. 2 is a schematic side view partially in section of a first detail of the device of FIG. 1.
Figure 2B:
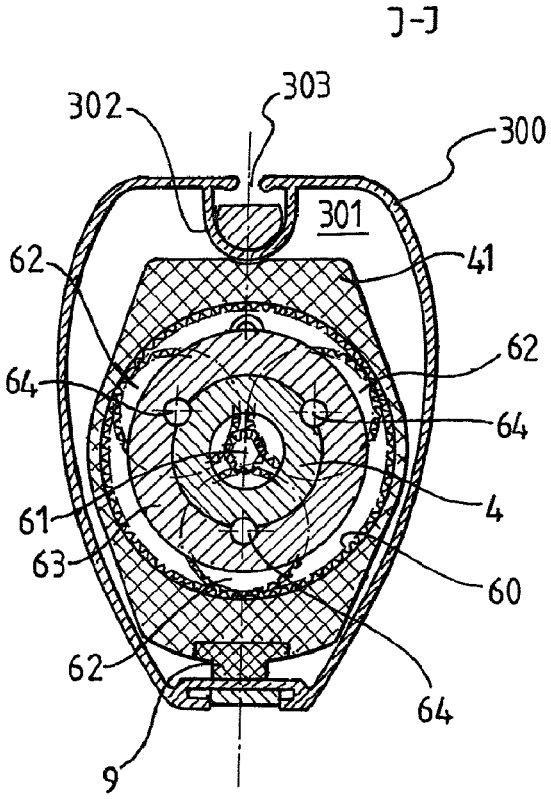
Figure 2A:
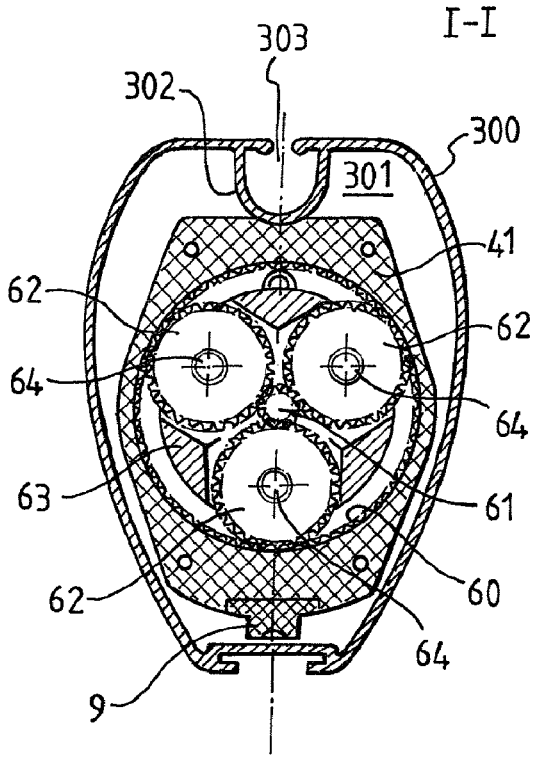
Figure 3:
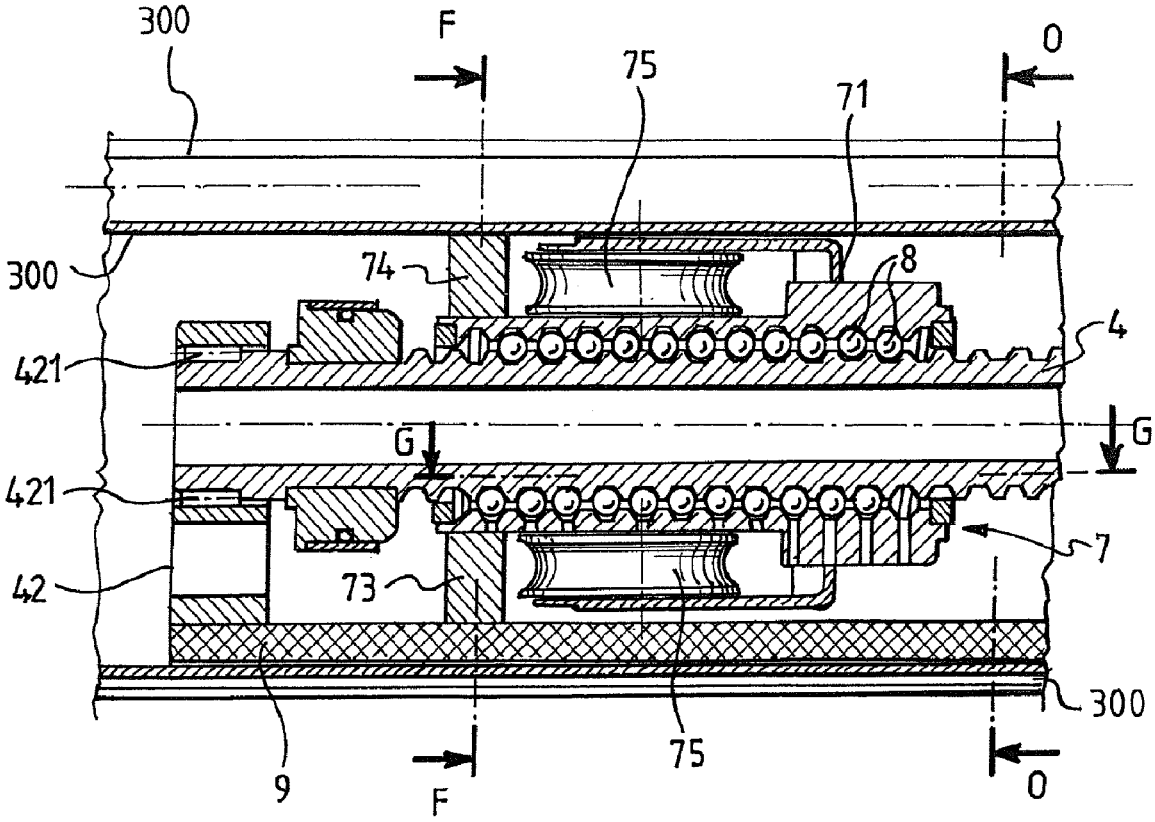
Figure 3B:
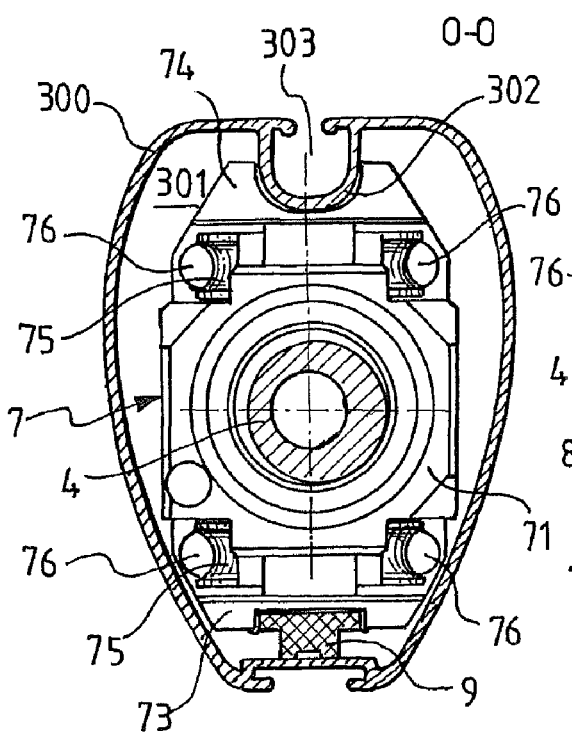
Figure 3C:
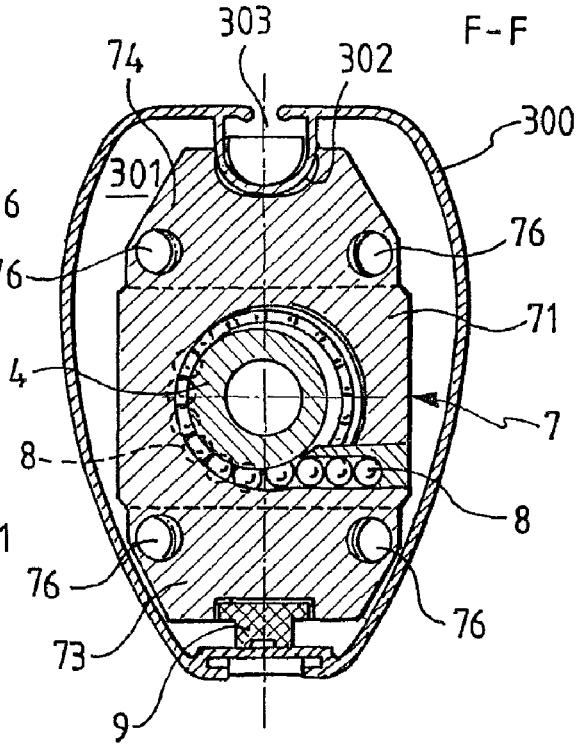
Figure 3A:
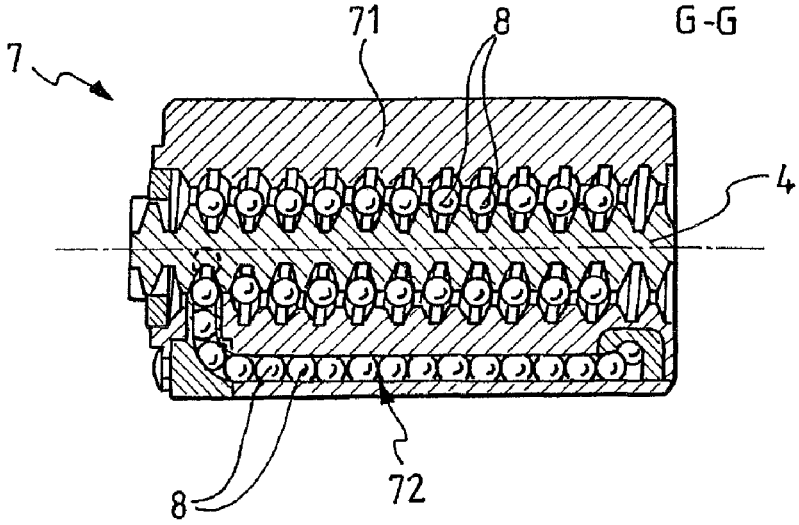
Figure 4:
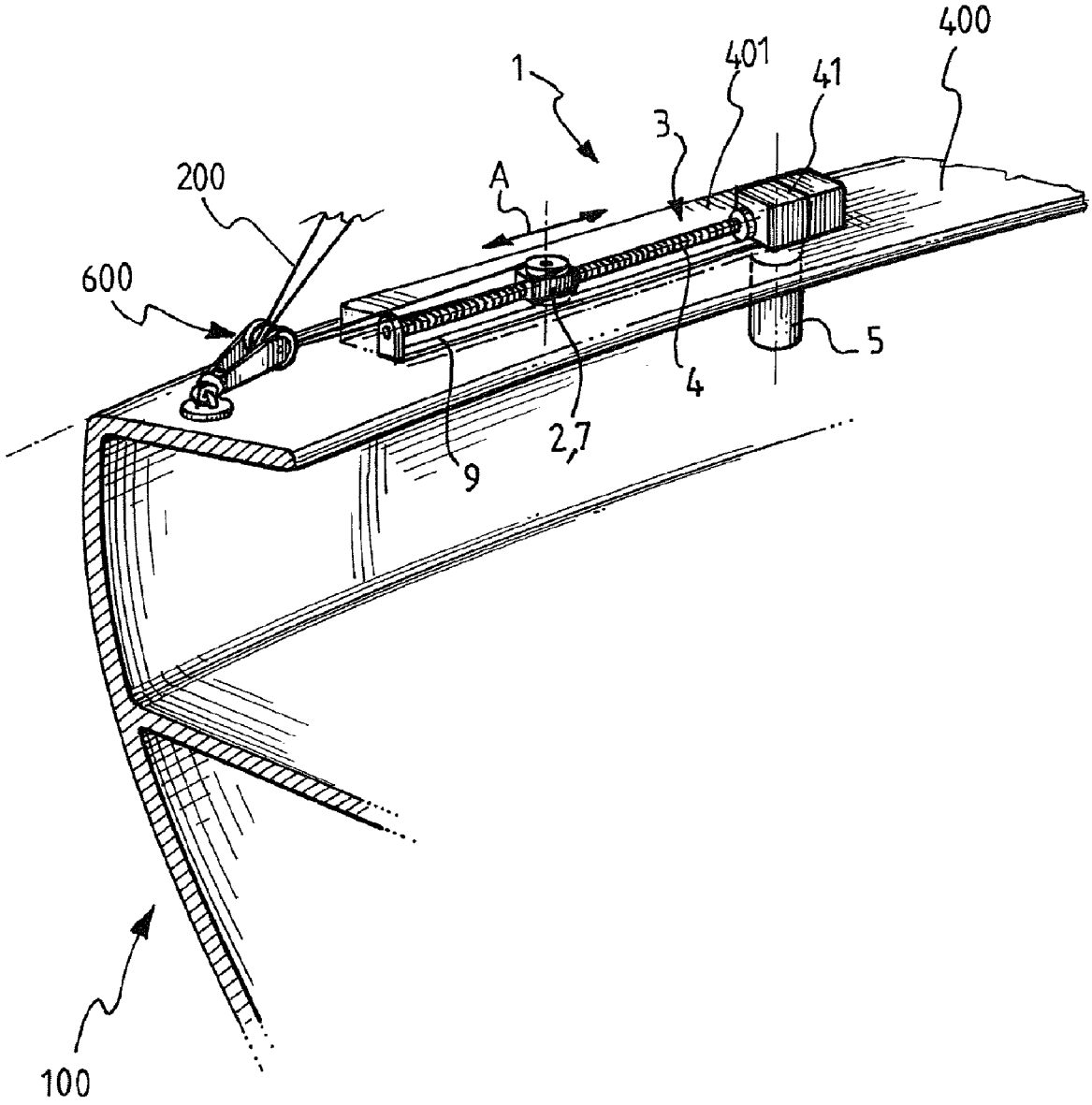

FIG. 2*a* is a schematic cross-sectional view of the detail of FIG. 2 along the line I-I of FIG. 2;

FIG. 2*b* is a schematic cross-sectional view of the detail of FIG. 2 along the line J-J of FIG. 2;

FIG. 3 is a schematic side view partially in section of a second detail of the device of FIG. 1;

FIG. 3*a* is a schematic longitudinal sectional view of the detail of FIG. 3 along the line G-G of FIG. 3;

FIG. 3*b* is a schematic longitudinal sectional view of the detail of FIG. 3 along the line O-O of FIG. 3;

FIG. 3*c* is a schematic cross-sectional view of the detail of FIG. 3 along the line F-F of FIG. 3;

FIG. 4 is a schematic perspective view of a device for actuating sheets according to the invention mounted on the deck of a sailing boat.

In such figures reference numeral 1 globally indicates a device for actuating sheets of sailing boats according to the invention.

The device 1 essentially comprises a pulling element 2 for a sheet 200 of a sailing boat 100 (only partially represented in FIGS. 1 and 4) and an actuator 3 connected to the pulling element 2 to cause the motion thereof. According to the invention, the actuator 3 comprises a screw 4 and a nut 7 engaged with each other. The screw 4 is made to rotate by motor means 5 through the interposition of a gear transmission 6. Further to the rotation of the screw 4, the nut 7, which constitutes the pulling element 2, translates linearly, as indicated by the double arrow A in FIGS. 1 and 4.

In the preferred embodiment of the invention, the actuator 3 is a ball screw actuator. Therefore, the screw 4 and the nut 7 cooperate with each other through the operative interposition of balls 8, which roll without sliding along a path defined by facing helical grooves formed in the screw 4 and in the nut 7.

The screw 4 and the nut 7 are preferably made of aluminium, or in any case of a metal alloy proof against salt corrosion. The balls 8 are preferably made of plastic material.

The motor means 5, for example consisting of a conventional direct current electric motor, can be substantially coaxial with respect to the screw 4, such as in the embodiment of the invention in which the device 1 is mounted inside a boom 300 of the sailing boat 100 (FIG. 1), or else they can have a respective longitudinal axis oblique to the screw 4, for example perpendicular, such as in the embodiment of the invention in which the device 1 is mounted on a deck 400 of the sailing boat 100 (FIG. 4), with the screw 4, the nut 7 and the gear transmission 6 on the outer side of the deck 400, preferably enclosed by a protective casing 401, and the motor means 5 under the deck.

The invention shall be illustrated in detail hereafter with reference to the embodiment in which the device 1 is mounted inside the boom 300, shown in FIGS. 1-3.

In this embodiment the screw 4 is mounted inside the boom 300 on annular supports 41 and 42 positioned respectively at its end connected to the motor means 5 and at its free end (FIGS. 2 and 3). The screw 4 is free to rotate with respect to the supports 41 and 42 thanks to the interposition of respective bearings 411 and 421. The bearing 411 at the support 41 on the motor side is preferably a roller thrust bearing, to withstand the axial loads deriving from the operation of the actuator 3.

The supports 41 and 42 are removably fixed to the wall of the boom 300 through conventional fastening means, not illustrated in detail. The support 41 on the motor side also defines a base for the attachment of the motor means 5 and houses, at an end portion thereof, the gear transmission 6.

The gear transmission 6 consists of an epicyclic reduction gear (FIGS. 2, 2*a* and 2*b*), comprising a fixed crown gear 60, formed on an inner wall of the support 41, a sun gear 61, defined by a toothed end portion of a drive shaft 50 of the motor means 5, and three planet gear 62, the rotation pins 64 of which are coupled together through a carrier 63. The carrier 63 is in turn made rotatably integral with the screw 4, preferably through longitudinal portions of the rotation pins 64, which therefore also carry out at least partially the function of key pins (FIGS. 2 and 2*b*).

Of course, in other embodiments of the device 1, and in particular in cases in which the longitudinal axes of the screw 4 and of the motor means 5 are not parallel or coincident, such as in the embodiment of FIG. 4 described above, a man skilled in the art can select a different type of gear transmission 6 suitable for the contingent constructive or operative requirements of the device 1.

The nut 7 (FIGS. 3 and 3*a*-*c*) comprises a nut body 71, substantially prism-shaped, arranged in a known way to ensure recirculation of the balls 8 through an outer recirculation duct 72 (FIG. 3*a*). In alternative embodiments and when the pitch allows it, it is however possible to provide an inner recirculation of the balls 8, through deviating inserts.

The nut body 71 is preferably provided with contact portions 73 and 74 that cooperate through shape coupling without interference with guide means associated with the actuator 3 and/or with wall portions of the boom 300. The constraint deriving from such a coupling prevents rotations of the nut 7 without hindering its axial translation, therefore ensuring the correct operation of the actuator 3.

In the preferred embodiment illustrated herein and as can be seen in particular in FIGS. 3*b* and 3*c*, the contact portion 73 cooperates with guide means in the form of a rail 9 that extends parallel to the screw 4 along the entire length thereof, whereas the contact portion 74 cooperates with an internally convex portion 302 of the wall of the boom 300, which forms a longitudinal cavity 303 outside of the boom 300 adapted to receive the base of a sail 500 (FIG. 1).

The nut 7 comprises two blocks 75 for connection with the sheet 200 to be actuated. The blocks 75 are preferably mounted at opposite faces of the nut 7, with rotation axes perpendicular to the translation direction A of the nut 7. In alternative embodiments, not illustrated, instead of the blocks 75 it is possible to use connection or deviation elements for the sheet 200 of a static type, such as, for example, eyelets or holes suitably arranged in the nut body 71.

If, as in the example embodiment illustrated herein, the position of the contact portions 73 and 74 on the nut 7 is such as to hinder the sheet 200 from reaching the blocks 75, in the contact portions 73 and 74 through holes 76 are formed to allow the passage of the sheet 200 (FIGS. 3*b* and 3*c*).

As schematically shown in FIGS. 1 and 4, the device 1 can cooperate with further pulley systems 600, arranged according to per sé known ways, for deviating the sheet 200 and/or for obtaining a multiplication effect of the actuation force.

The invention claimed is:

1. Device for actuating sheets of sailing boats so as to adjust a boom with respect to the boat comprising:

a pulling element for a sheet and an actuator connected to the pulling element for causing motion of the pulling element;

wherein the actuator comprises a screw and a nut engaged with each other and wherein rotation of the screw causes the nut to translate linearly; and wherein linear translation of the nut moves the pulling element and actuates the sheet to adjust the tension in the sheet, thereby causing the boom to move from a first position to a second position with respect to the boat and adjust an angle of incidence that a sail attached to the boom presents to the wind.

2. Device according to claim 1, wherein the nut of the actuator is the pulling element.

3. Device according to claim 1, wherein the actuator comprises rolling elements operatively interposed between the screw and the nut.

4. Device according to claim 3, wherein the actuator is a ball screw actuator.

5. Device according to claim 1, wherein the actuator comprises a motor to make the screw rotate and wherein the motor is substantially coaxial with the screw.

6. Device according to claim 1, wherein the actuator comprises a motor to make the screw rotate and wherein the motor is axially oblique with respect to the screw.

7. Device according to claim 5 or 6, wherein the actuator comprises a gear transmission operatively interposed between the motor and the screw.

8. Device according to claim 7, wherein the gear transmission comprises an epicyclic reduction gear.

9. Device according to claim 3, wherein the rolling elements operatively interposed between the screw and the nut of the actuator are made of plastic material.

10. Device according to claim 1, wherein the screw and the nut of the actuator are made of aluminium.

11. Device according to claim 1, wherein the pulling element comprises at least one block.

12. Boom of a sailing boat provided with a device for actuating sheets according to any one of claims 1 to 11.

13. Boom according to claim 12 comprising a longitudinal inner cavity and wherein the device for actuating sheets is housed in the inner cavity.

14. Boom according to claim 13, wherein the nut of the actuator of the device for actuating sheets translates linearly and in such a translation cooperates with at least one longitudinal portion of the inner cavity of the boom.

15. Boom of a sailing boat, the boom being adapted to have a sail attached thereto and comprising:

a longitudinal inner cavity and a device for actuating sheets housed in the inner cavity;

the device for actuating sheets comprising a pulling element for a sheet and an actuator connected to the pulling element for causing motion of the pulling element and a moving of the boom from a first position to a second position with respect to the boat so as to adjust an angle of incidence that the sail attached to the boom presents to the wind;

the actuator comprises a screw and a nut engaged with each other; and wherein rotation of the screw causes linear translation of the nut, and wherein the nut is at least partially guided within the inner cavity of the boom; so as to prevent rotation thereof during translation movements of the nut.

16. Device for actuating sheets of sailing boats so as to adjust a boom with respect to the boat comprising:

a pulling element for a sheet and an actuator connected to the pulling element for causing motion of the pulling element;

wherein the actuator comprises a screw and a nut engaged with each other and wherein rotation of one of the screw and the nut causes the other of the screw and the nut to translate linearly; and wherein linear translation of the other of the screw and the nut moves the pulling element and actuates the sheet to adjust the tension in the sheet, thereby causing the boom to move from a first position to a second position with respect to the boat and adjust an angle of incidence that a sail attached to the boom presents to the wind.

17. Device according to claim 16, wherein the actuator comprises rolling elements operatively interposed between the screw and the nut.

18. Device according to claim 16, wherein the actuator comprises a motor to make the screw rotate.

19. Device according to claim 18, wherein the actuator comprises a gear transmission operatively interposed between the motor and the screw.

20. Boom according to claim 16 comprising a longitudinal inner cavity and wherein the device for actuating sheets is housed in the inner cavity.

* * * * *